US005952897A

United States Patent [19]

Ogura et al.

[11] Patent Number: 5,952,897

[45] Date of Patent: Sep. 14, 1999

[54] DIELECTRIC FILTER UNIT COMPRISING INTERNAL CONDUCTORS AND A SLIT WITH AN ELECTRODE FOR INPUT/ OUTPUT COUPLING STRUCTURE

[75] Inventors: Hiromi Ogura; Kikuo Tsunoda, both of Ishikawa-ken, Japan

[73] Assignee: Murata Manufacturing Co., Ltd., Japan

[21] Appl. No.: 08/932,021

[22] Filed: Sep. 17, 1997

[30] Foreign Application Priority Data

Sep. 19, 1996 [JP] Japan ..... 8-247673

[51] Int. Cl.[6] ..... H01P 5/12; H01P 1/205

[52] U.S. Cl. ..... 333/134; 333/206

[58] Field of Search ..... 333/126, 129, 333/134, 202, 206, 207

[56] References Cited

U.S. PATENT DOCUMENTS

| | | | |
|---|---|---|---|
| 5,250,916 | 10/1993 | Zakman | 333/206 |
| 5,488,335 | 1/1996 | Agahi-Kesheh et al. | 333/206 |
| 5,512,866 | 4/1996 | Vangala et al. | 333/206 X |
| 5,537,082 | 7/1996 | Tada et al. | 333/202 |

FOREIGN PATENT DOCUMENTS

| | | | |
|---|---|---|---|
| 0688059 | 6/1995 | European Pat. Off. . | |
| 59-104801 | 6/1984 | Japan | 333/202 |
| 9410719 | 5/1994 | WIPO . | |

OTHER PUBLICATIONS

European Search Report dated Dec. 30, 1997.

*Primary Examiner*—Seungsook Ham
*Attorney, Agent, or Firm*—Ostrolenk, Faber, Gerb & Soffen, LLP

[57] ABSTRACT

A miniaturized dielectric filter unit exhibiting desired characteristics is formed in which a plurality of resonators are disposed within a dielectric block. A plurality of internal conductors are disposed within the dielectric block. An external conductor and an input/output electrode are formed on an outer surface of the dielectric block. A slit having an electrode therein, which is electrically connected to the input/output electrode, is provided each of between two adjacent through-holes having the internal conductors therein. Thus, unwanted coupling between the input/output sharing filters is prevented, and an external coupling circuit is configured by capacitive coupling. It is thus possible to individually design the respective filters and further to enhance easy designing of the overall filter unit. A transmitting/receiving-sharing unit and a multiplexer, both of which are similar to the above-described dielectric filter unit, are also provided.

6 Claims, 10 Drawing Sheets

DIELECTRIC FILTER UNIT COMPRISING INTERNAL CONDUCTORS AND A SLIT WITH AN ELECTRODE FOR INPUT/OUTPUT COUPLING STRUCTURE

BACKGROUND OF THE INVENTION

1. Field of the Invention

The present invention relates to a dielectric filter unit formed by disposing a plurality of resonators in a dielectric block. The invention also relates to a transmitting/receiving-sharing unit and a multiplexer, both of which are configured similar to the above dielectric filter unit.

2. Description of the Related Art

A typical example of a known dielectric filter unit having a plurality of filters formed in a single dielectric block is shown in FIG. 11. In FIG. 11, a dielectric block 1 has an external conductor 8 on the outer surfaces other than the top surface of the block 1. A plurality of through-holes 2, 3*a*, 3*b*, etc. for receiving internal conductors therein are provided on the top surface of the block 1. Further, electrodes, which are continuously extending from the exposed surface (top surface of FIG. 11), are formed to capacitively couple adjacent resonators. Moreover, an input/output electrode 7*a* is disposed between the adjacent internal-conductor through-holes 2 and 3*a* on the exposed surface of the block 1, thereby capacitively coupling the input/output electrode 7*a* and its adjacent internal conductors. In this example shown in FIG. 11, the internal-conductor through-hole 2 serves as a trap circuit, while the internal-conductor through-holes 3*a*, 3*b*, etc. function as a band-pass filer (BPF). Also, the input/output electrode 7*a* is shared between the trap circuit and the band-pass filter.

The above types of dielectric filter units used as an antenna sharing unit by forming a plurality of filters in a single dielectric block are disclosed, for example, in (1) PCT/US93/03693 WO93/24968 and (2) PCT/US95/01676 WO95/30250. The publication (1) discloses a dielectric filter unit, configured in a manner similar to the unit shown in FIG. 11, in which a common input/output electrode is provided each at the input/output portion between a trap circuit and a BPF and at the input/output portion between BPFs. The publication (2) discloses a dielectric filter unit in which an input/output electrode is coupled to a resonator interposed between two BPFs.

The above known types of dielectric filter units however present the following problems. In the filter units of the types shown in FIG. 11 and disclosed in the publication (1), since the two filters having the common input/output electrode are located in proximity with each other across the electrode, unwanted coupling is caused between the filters, thereby failing to obtain desired characteristics. If the distance between the two adjacent filters is increased to overcome the above drawback, the overall filter unit is disadvantageously enlarged. Further, in the filter unit of the type disclosed in the publication (2), since a resonator is shared between two filters, an external coupling circuit is also shared therebetween, thereby making the design of the filter unit complicated and also decreasing the design flexibility.

SUMMARY OF THE INVENTION

Accordingly, it is an object of the present invention to provide a miniaturized dielectric filter unit in which unwanted coupling is prevented between two filters sharing an input/output portion, and the individual filters can be designed independently to facilitate easy designing of the overall unit, thereby obtaining desired characteristics, and also to provide a transmitting/receiving-sharing unit and a multiplexer, both of which are configured similar to the above dielectric filter unit.

In order to achieve the above object, according to one aspect of the present invention, there is provided a dielectric filter unit comprising: a dielectric block; a plurality of internal conductors disposed within the dielectric block; and an external conductor and a signal input/output electrode disposed on an external surface of the dielectric block, wherein a slit having an electrode therein, the electrode being electrically connected to the input/output electrode, is provided between the two adjacent internal conductors.

According to another aspect of the present invention, there is provided a dielectric block; a plurality of internal conductors disposed within the dielectric block; and an external conductor and a signal input/output electrode disposed on an external surface of the dielectric block, wherein a slit having an electrode therein is provided between the two adjacent internal conductors, and capacitance is generated between the electrode within the slit and the input/output electrode.

Since a slit having an electrode therein is provided between the two adjacent internal conductors, as noted above, coupling between the two conductors across the slit can be prevented, which would otherwise generate unwanted coupling between the filters across the slit. It is thus possible to decrease the distance between the two filters and further to downsize the overall filter unit.

According to the former aspect of the present invention, since the electrode within the slit is capacitively coupled to each of the resonators, which are part of the filters, positioned across the slit, it can be shared between the two filters as an input/output electrode.

According to the latter aspect of the present invention, since the internal conductors across the slit are capacitively coupled to the input/output electrode via the electrode within the slit, the input/output electrode can be shared between the two filters.

Further, the slit having an electrode therein and the input/output electrode, which are used in the dielectric filter unit according to one of the aspects of the present invention, are provided at least in three areas of the dielectric block. Among the input/output electrodes, the predetermined input/output electrode is used as a transmitting/receiving-signal connecting electrode, while the other input/output electrodes are employed as a transmitting-signal input electrode and a receiving-signal output electrode, respectively. With this arrangement, a transmitting/receiving-sharing unit, such as an antenna sharing unit, is configured.

Moreover, the slit having an electrode therein and the input/output electrode, which are used in the dielectric filter unit according to one of the aspects of the present invention, are provided at least in three areas. Among the input/output electrodes, the predetermined input/output electrode is used as an output-signal connecting electrode or an input-signal connecting electrode. If the above electrode is used as an output-signal connecting electrode, the other input/output electrodes are employed as input-signal connecting electrodes, and vice versa. With this configuration, a multiplexer is formed.

DETAILED DESCRIPTION OF EMBODIMENTS OF THE INVENTION

The configuration of an antenna sharing unit according to a first embodiment of the present invention will now be explained with reference to FIGS. 1 through 3.

Figure 1:
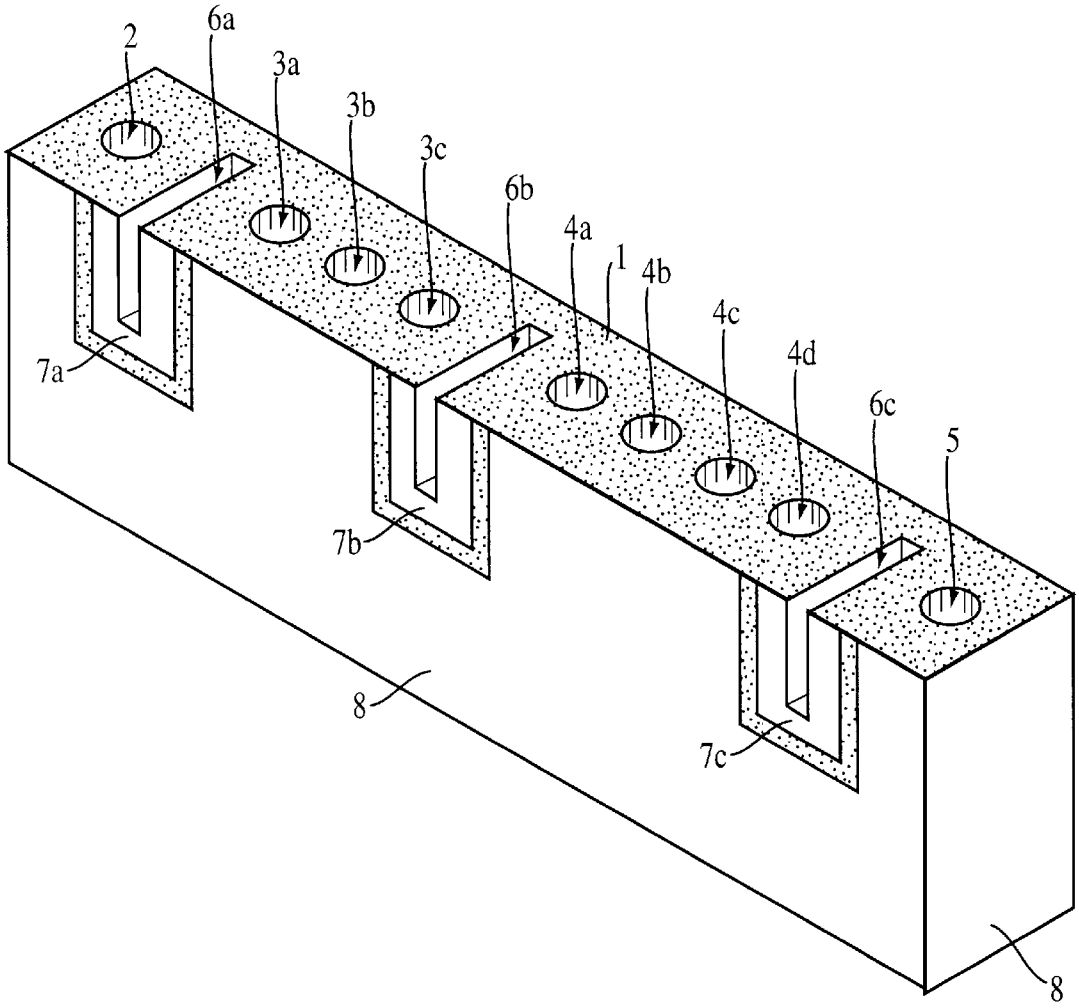
FIG. 1 is a perspective view illustrating an antenna sharing unit according to a first embodiment of the present invention.

FIG. 1 is a perspective view illustrating an antenna sharing unit which is vertically placed. In FIG. 1, a dielectric ceramic block 1 generally formed in a rectangular-prism shape has through-holes 2, 3*a*, 3*b*, 3*c*, 4*a*, 4*b*, 4*c*, 4*d* and 5, which vertically pass through the block 1, as viewed from FIG. 1, for respectively receiving internal conductors therein. Formed in each through-hole is an internal conductor formed of an Ag electrode. Slits 6*a*, 6*b* and 6*c* are formed between the through-holes 2 and 3*a*, between the through-holes 3*c* and 4*a*, and between the through-holes 4*d* and 5, respectively, and an electrode is further disposed in each of the slits 6*a*, 6*b* and 6*c*. Moreover, input/output electrodes 7*a*, 7*b* and 7*c*, which extend from the electrodes inside the slits 6*a*, 6*b* and 6*c*, respectively, are provided on the surface on the proximal left side of FIG. 1. For practical use, the dielectric block 1 is surface-mounted on a board with the surface provided with the input/output electrodes (the proximal left side of FIG. 1) in contact with the board. Additionally, an external conductor 8 is formed on the overall surfaces of the block 1 other than the top surface and the input/output electrodes 7*a*, 7*b* and 7*c*.

Figure 2A:
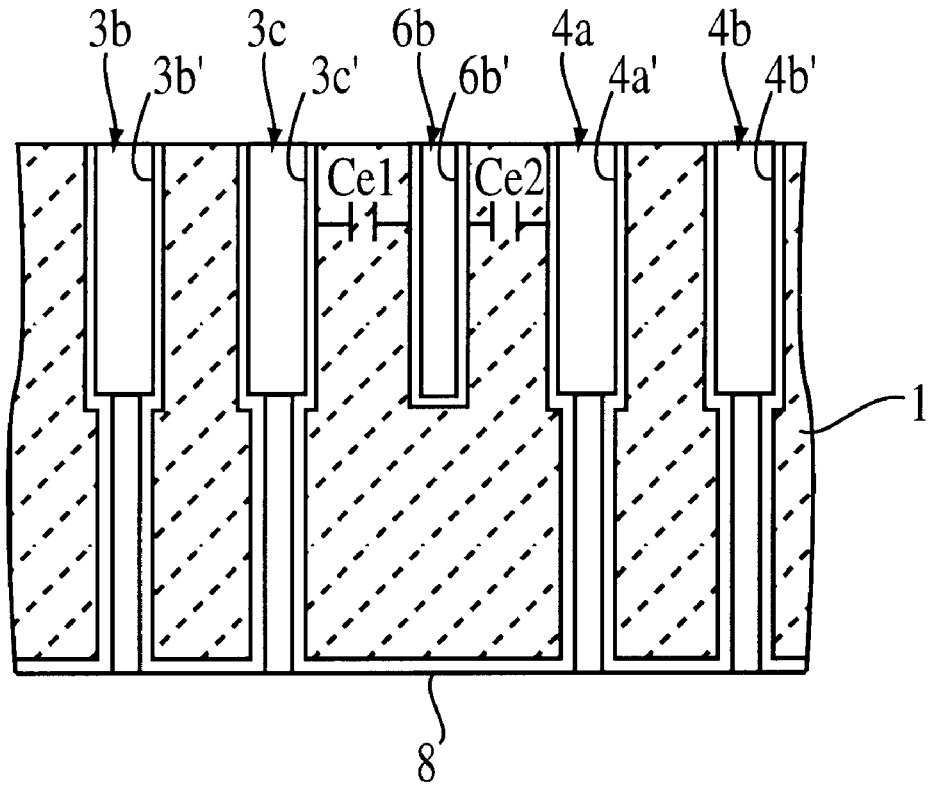
FIG. 2, which is comprised of FIGS. 2A and 2B, is a sectional view in part of the antenna sharing unit shown in FIG. 1.
Figure 2B:
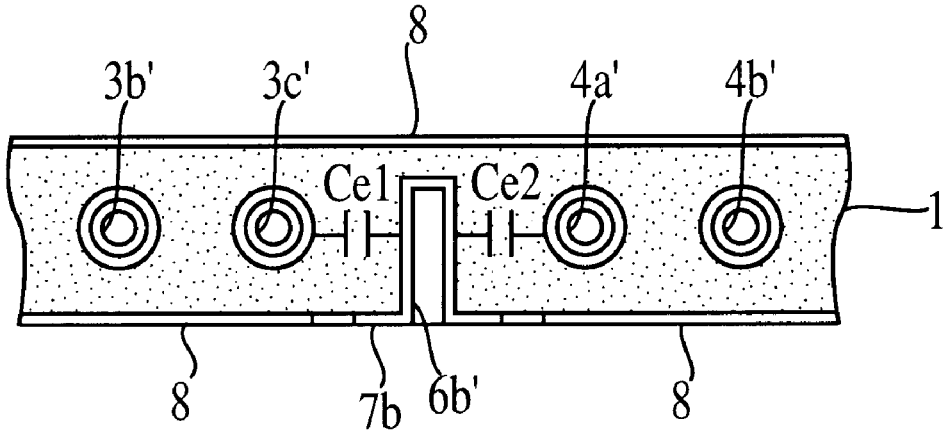

FIG. 2 is a sectional view in part of the antenna sharing unit shown in FIG. 1: FIG. 2A is a sectional view along the axis of the internal-conductor through-holes; and FIG. 2B is a sectional view in the direction perpendicular to the axis of the internal-conductor through-holes. In FIG. 2, reference numerals 3*b*′, 3*c*′, 4*a*′ and 4*b*′ indicate internal conductors formed within the through-holes 3*b*, 3*c*, and 4*a* and 4*b*, respectively, and 6*b*′ represents an electrode disposed within the slit 6*b*. In this embodiment the slit 6*b* is formed on the exposed surface, i.e., on the surface having high electric-field energy, between the adjacent internal conductors 3*c*′ and 4*a*′ so as to receive the electrode 6*b*′ therein. This inhibits unwanted coupling of the resonators formed by the internal conductors 3*c*′ and 4*a*′. Meanwhile, external coupling capacitors Ce1 and Ce2 are formed between the electrode 6*b*′ and the internal conductor 3*c*′ and between the electrode 6*b*′ and the internal conductor 4*a*′, respectively, thereby forming an external-coupling circuit shared by the two filters. In the embodiment shown in FIGS. 1 and 2, the internal-conductor through-holes having the same internal diameters are disposed at an equal pitch (a constant pitch). However, the through-holes may have different internal diameters and also may be disposed at different pitches between the transmitting filter and the receiving filter in response to the required characteristics of the respective filters (which will be described in detail later). Further, in this embodiment the through-holes are configured as stepped through-holes (the internal diameters vary stepwise) in accordance with the respective required filter characteristics. The position of the steps may be different between the through-holes, and the depth of the slit is not necessarily on the same level as the position of the steps.

Figure 3:
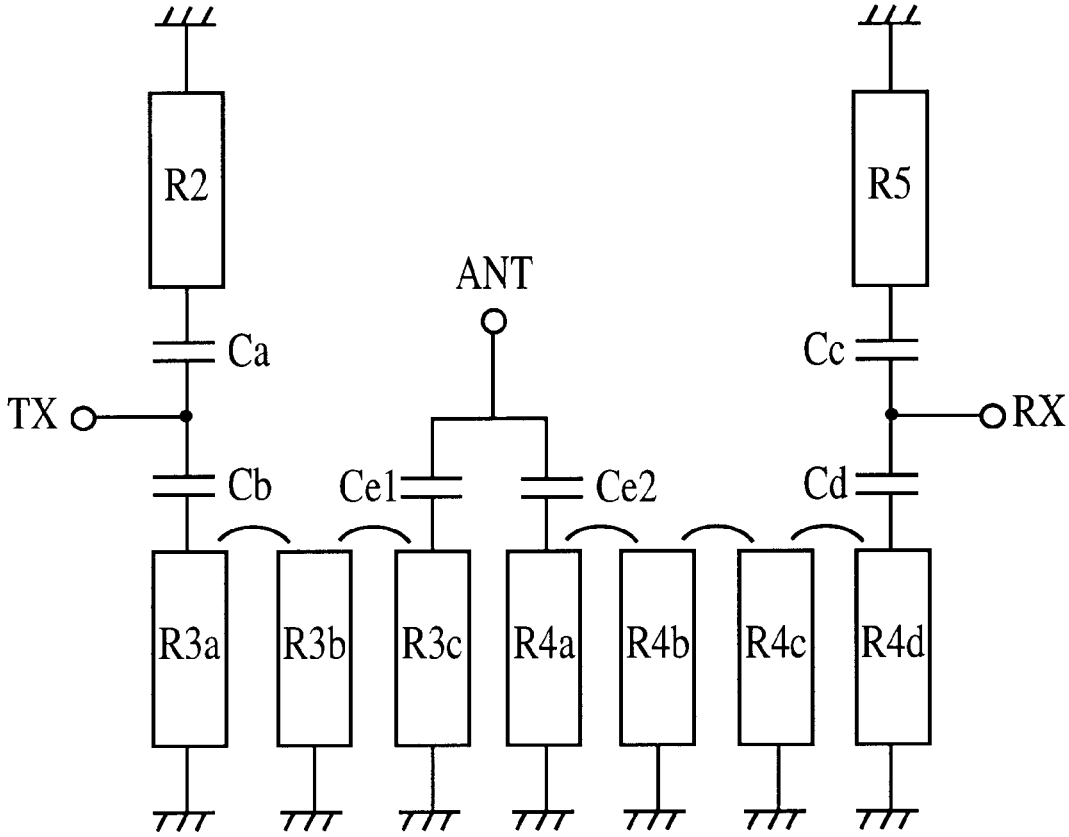
FIG. 3 is a diagram illustrating an equivalent circuit of the antenna sharing unit shown in FIG. 1.

FIG. 3 is an equivalent circuit of the antenna sharing unit shown in FIG. 1. In FIG. 3, R2 designates a resonator formed by the through-hole 2 shown in FIG. 1 (strictly speaking, although the resonator is formed by the internal conductor provided in the through-hole 2, the dielectric block 1 and the external conductor 8, it is simply referred to as "the resonator formed by the through-hole 2); R3*a*, R3*b* and R3*c* indicate resonators formed by the through-holes 3*a*, 3*b* and 3*c*, respectively; R4*a*, R4*b*, R4*c* and R4*d* represent resonators formed by the through-holes 4*a*, 4*b*, 4*c* and 4*d*, respectively; and R5 depicts a resonator formed by the through-hole 5. The resonators R3*a* through R3*c* serve as a band-pass filter (BPF) formed of three stages of resonators, while the resonators R4*a* through R4*d* function as a BPF formed of four stages of resonators. The resonators R2 and R5 each serve as a trap circuit formed of a one-stage resonator. Further, Ca and Cb indicate capacitors generated between the conductor within the through-hole 2 and the electrode within the slit 6*a* and between the conductor within the through-hole 3*a* and the electrode within the slit 6*a*, respectively, while Cc and Cd designate capacitors produced between the conductor within the through-hole 5 and the electrode within the slit 6*c* and between the conductor within the through-hole 4*d* and the slit 6*c*, respectively. Moreover, Ce1 and Ce2 represent capacitors generated between the conductor within the through-hole 3*c* and the electrode within the slit 6*b* and between the conductor within the through-hole 4*a* and the electrode within the slit 6*b*, respectively. With this configuration, the following type of antenna sharing unit can be constructed in which the resonators R2, R3*a*, R3*b* and R3*c* serve as a transmitting filter, while the resonators R5, R4*a*, R4*b*, R4*c* and R4*d* function as a receiving filter. Namely, the unit shown in FIG. 1 is used as an antenna sharing unit in which the input/output electrodes 7*a*, 7*b* and 7*c* serve as a transmitting-signal (Tx) input electrode, an antenna-connecting (ANT) electrode, and a receiving-signal (Rx) output electrode, respectively.

Figure 4:
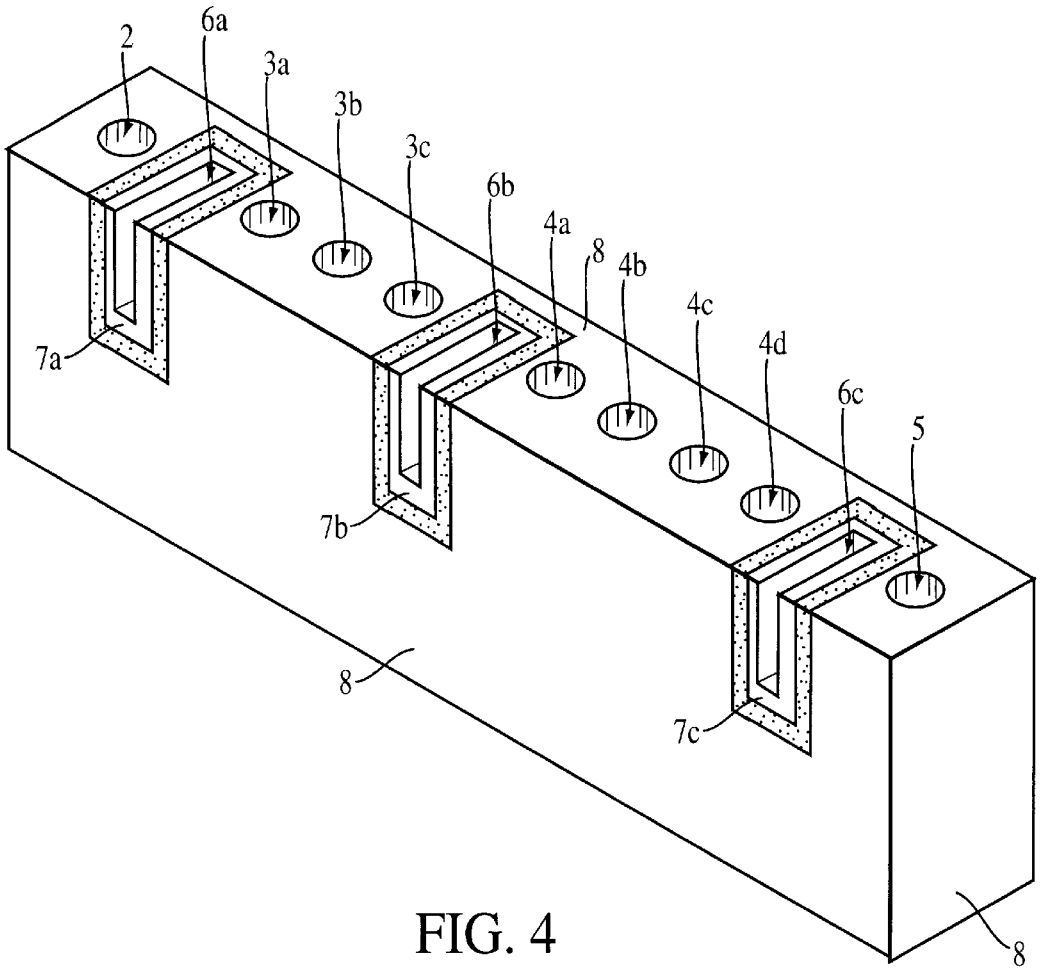
FIG. 4 is a perspective view illustrating an antenna sharing unit according to a second embodiment of the present invention.
Figure 5:
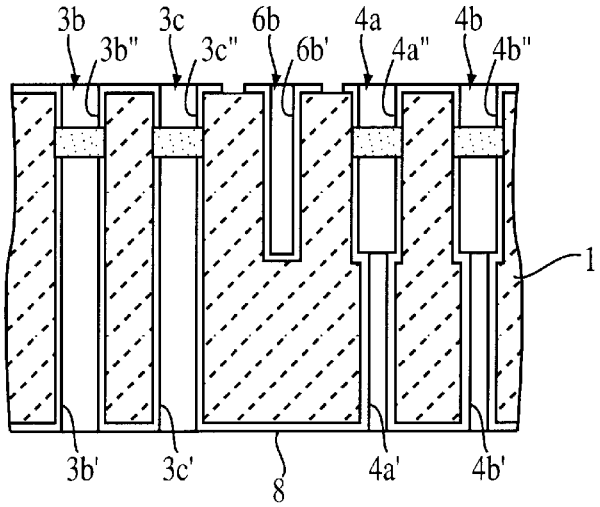
FIG. 5 is a sectional view in part of the antenna sharing unit shown in FIG. 4.

An explanation will now be given of the configuration of an antenna sharing unit according to a second embodiment of the present invention with reference to FIGS. 4 and 5. FIG. 4 illustrates the antenna sharing unit which is vertically placed. For practical use, the unit is surface-mounted on a board with the top surface of the block 1 or the surface on the proximal side of FIG. 4 in contact with the board. In the second embodiment, unlike the first embodiment, substantially all the surfaces of the block 1 are covered with the external conductor 8 rather than being exposed. Further, the input/output electrodes 7*a*, 7*b* and 7*c* are extended to the exposed surface of the block 1 on which the through-holes 2, 3*a* through 3*c*, 4*a* through 4*d*, and 5 are formed. FIG. 5 is a sectional view in part along the axis of the internal-conductor through-holes.

FIG. 5 reveals that a conductor-free region is provided in part of each through-hole so as to divide the conductors into the resonator electrodes 3*b*′, 3*c*′, 4*a*′ and 4*b*′ and the forward-end capacitor electrodes 3*b*″, 3*c*″, 4*a*″ and 4*b*″, respectively. Likewise, the other internal conductors are divided into the corresponding resonator electrodes and the forward-end capacitor electrodes. Further, in this embodiment the through-holes 3*a* through 3*c* are configured as straight holes (having a constant internal diameter), while the through-holes 4*a* through 4*d* are configured as stepped holes (the internal diameter varies stepwise). It is thus possible to respond to the required characteristics of the respective filters. With this arrangement, the internal-conductor through-holes 3*a* through 3*c* are comb-line-coupled to each other to form three stages of resonators serving as a BPF, while the internal-conductor through-holes 4*a* through 4*d* are comb-line-coupled to each other to form four stages of resonators serving as a BPF. The through-holes 2 and 5 are each used as a trap circuit. Further, capacitors are generated between the electrode within the slit 6*a* and the resonator electrode within the through-hole 2 and between the electrode within the slit 6*a* and the resonator electrode within the through-hole 3*a*, respectively; capacitors are produced between the electrode within the slit 6*b* and the resonator electrode within the through-hole 3*c* and between the electrode within the slit 6*b* and the resonator electrode within the through-hole 4*a*; and capacitors are generated between the electrode within the slit 6*c* and the resonator electrode within the through-hole 4*d* and between the electrode within the slit 6*c* and the resonator electrode within the through-hole 5. Accordingly, in this embodiment, as well as the previous embodiment, the input electrodes 7*a*, 7*b* and 7*c*, continuously extending from the electrodes formed within the slits 6*a*, 6*b* and 6*c*, can be used as a Tx electrode, an ANT electrode, and a Rx electrode, respectively. Additionally, in the second embodiment shown in FIG. 4, since the input/output electrodes 7*a*, 7*b* and 7*c* extend to the top surface of the block 1, the top surface may be used as a mounting surface.

Figure 6:
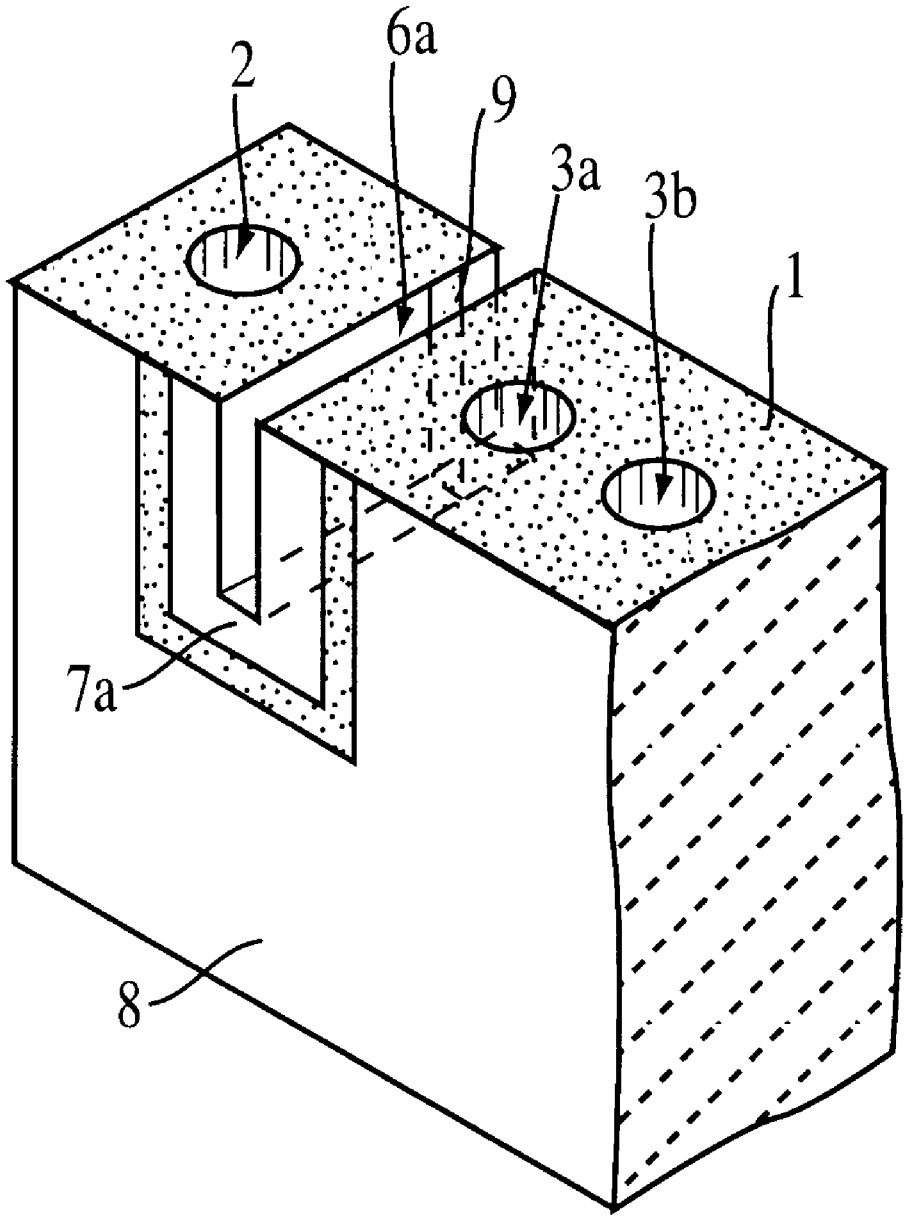
FIG. 6 is a perspective view in part illustrating an antenna sharing unit according to a third embodiment of the present invention.

The configuration of an antenna sharing unit according to a third embodiment of the present invention will now be described while referring to FIG. 6. The antenna sharing unit of the third embodiment is a modification made to the unit shown in FIG. 1, and is partially shown in FIG. 6. FIG. 6 reveals that the slit 6*a* is formed to pass through the dielectric block 1 in the widthwise direction, and an electrode-free portion 9 is disposed in the slit 6*a* to establish an insulation between the electrode within the slit 6*a* and the external conductor 8.

Figure 7A:
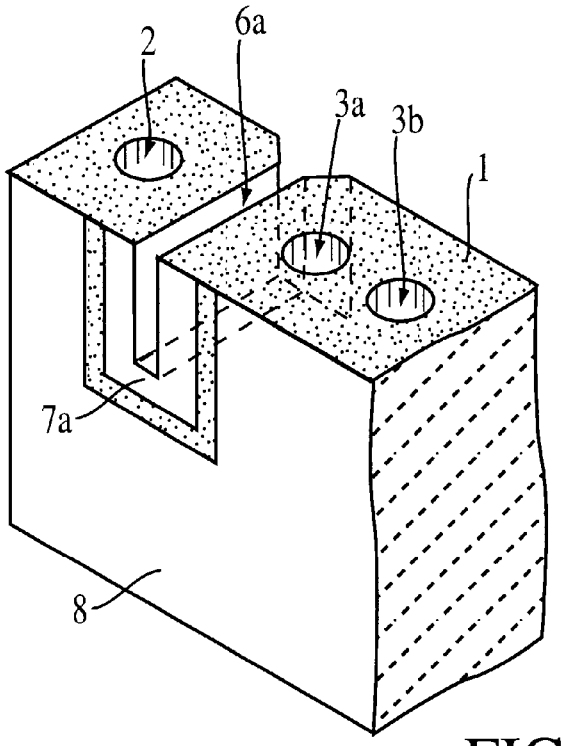
FIG. 7, which is comprised of FIGS. 7A and 7B, is a perspective view in part illustrating an antenna sharing unit according to a fourth embodiment of the present invention.
Figure 7B:
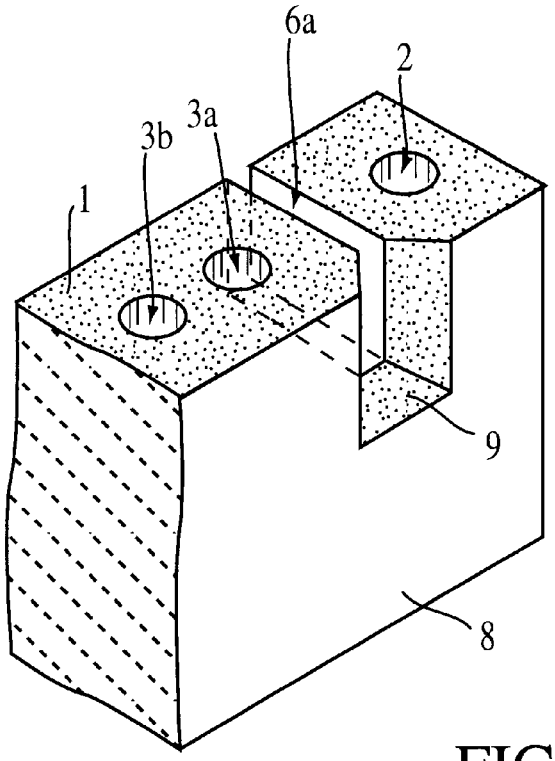

FIG. 7A is a perspective view in part of an antenna sharing unit according to a fourth embodiment of the present invention. FIG. 7B is a rear view of the unit shown in FIG. 7A and shows that on the surface of the slit 6*a* an electrode-free portion 9 is formed as a tapered notch on which the input/output electrode 7*a* is not formed. Thanks to the electrode-free portion 9, the electrode within the slit 6*a* and the external conductor 8 can be insulated.

Figure 8A:
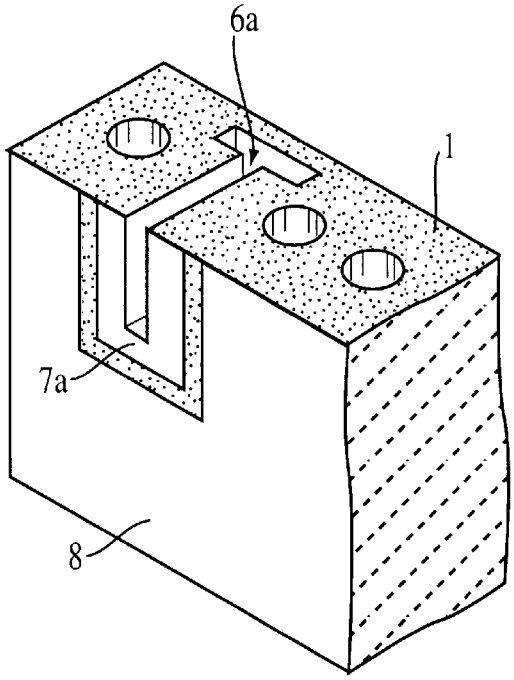
FIG. 8, which is comprised of FIGS. 7A, 7B and 7C, is a perspective view in part illustrating an antenna sharing unit according to a fifth embodiment of the present invention.
Figure 8C:
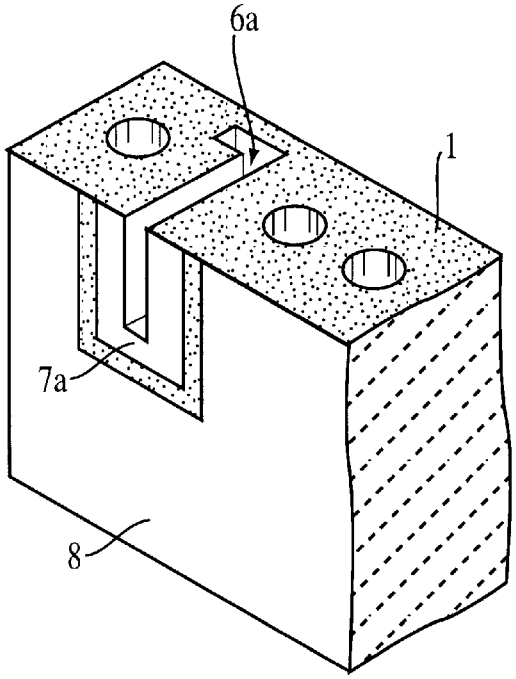
Figure 8B:
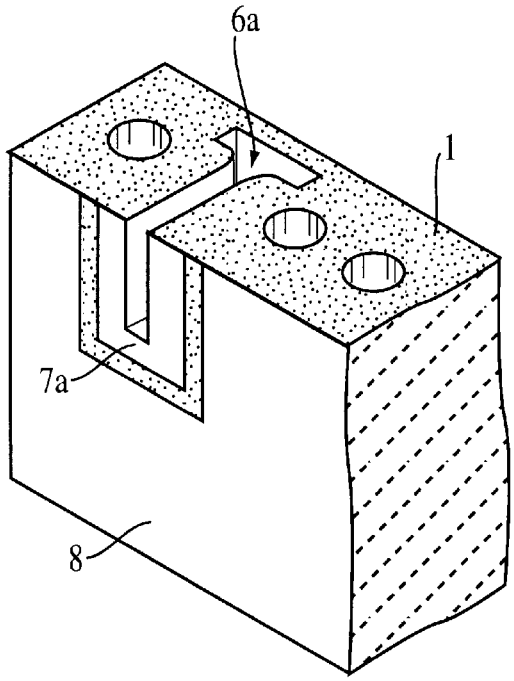

FIG. 8 is a perspective view in part of an antenna sharing unit according to a fifth embodiment of the present invention. Although linear slits are provided for the first through the fourth embodiments, in the fifth embodiment the slits are branched off in a midpoint into a plurality of portions. FIG. 8A illustrates an antenna sharing unit in which a T-shaped slit in cross section is formed; FIG. 8B illustrates a unit in which a predetermined portion of the T-shaped slit is curved; and FIG. 8C illustrates a unit in which a hook-shaped slit in cross section is formed. This configuration makes it possible to increase the opposing areas between the electrode within the slit and each of the internal conductors within the two adjacent through-holes across the slit. As a consequence, the required capacitance can be easily obtained even though, for example, the depth of the slit is decreased.

Figure 9A:
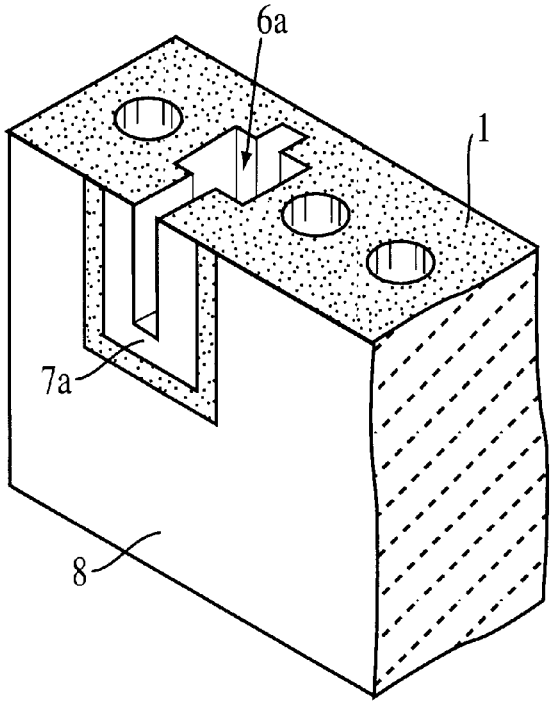
FIG. 9, which is comprised of FIGS. 9A and 9B, is a perspective view in part illustrating an antenna sharing unit according to a sixth embodiment of the present invention.
Figure 9B:
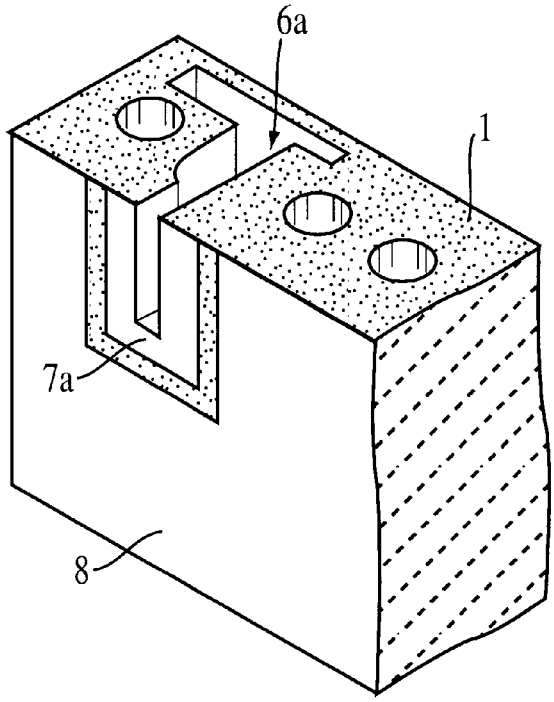

FIG. 9 illustrates an antenna sharing unit according to a sixth embodiment of the present invention. In the fifth embodiment illustrated in FIG. 8, the slit 6*a* is extended to the portion between the through-hole and the lateral surface of the dielectric block 1 so as to obtain a sufficient capacitance between the electrode within the slit and the conductor within the through hole. In the sixth embodiment, however, the width of the slit 6*a* along which the through-holes are arranged is enlarged, as shown in FIGS. 9A and 9B, to decrease the distance between the internal conductor in the through-hole and the electrode within the slit 6*a*, thereby ensuring the required capacitance therebetween. In particular, in the embodiment shown in FIG. 9B, not only the width of the slit 6*a* along which the through-holes are arranged is enlarged, but also the slit 6*a* is extended to the portion between the through-holes and the lateral surface of the dielectric block 1, thereby obtaining the required capacitance between the slit 6*a* and each of the adjacent through-holes.

Figure 10A:
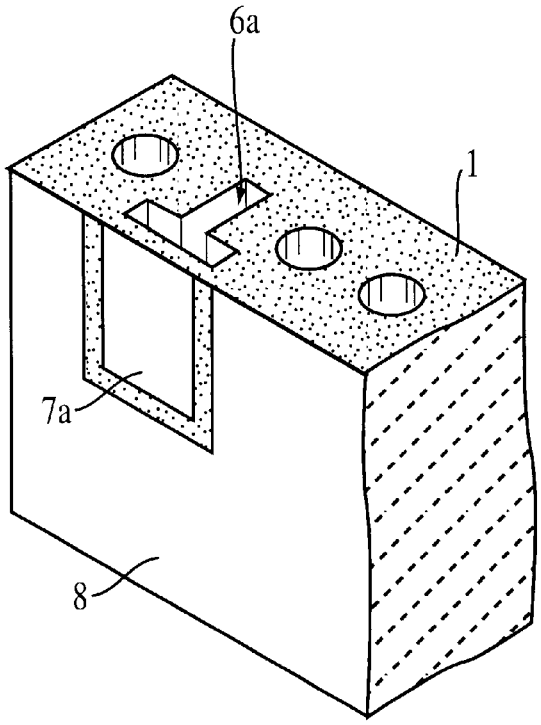
FIG. 10, which is comprised of FIGS. 10A and 10B, is a perspective view in part illustrating an antenna sharing unit according to a seventh embodiment of the present invention.
Figure 10B:
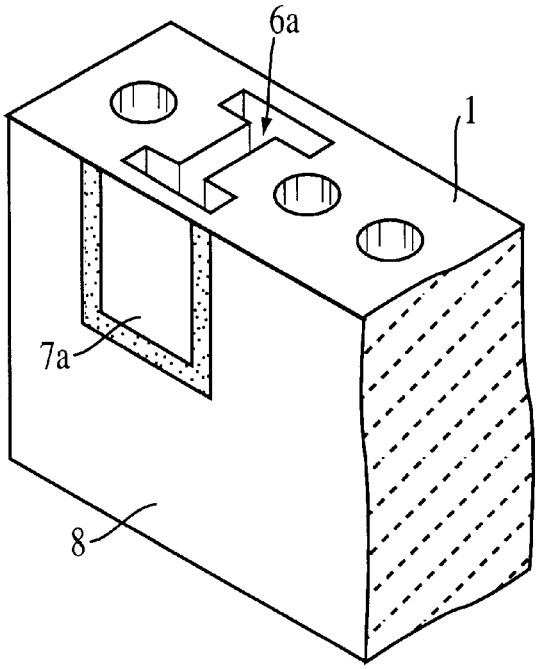
Figure 11:
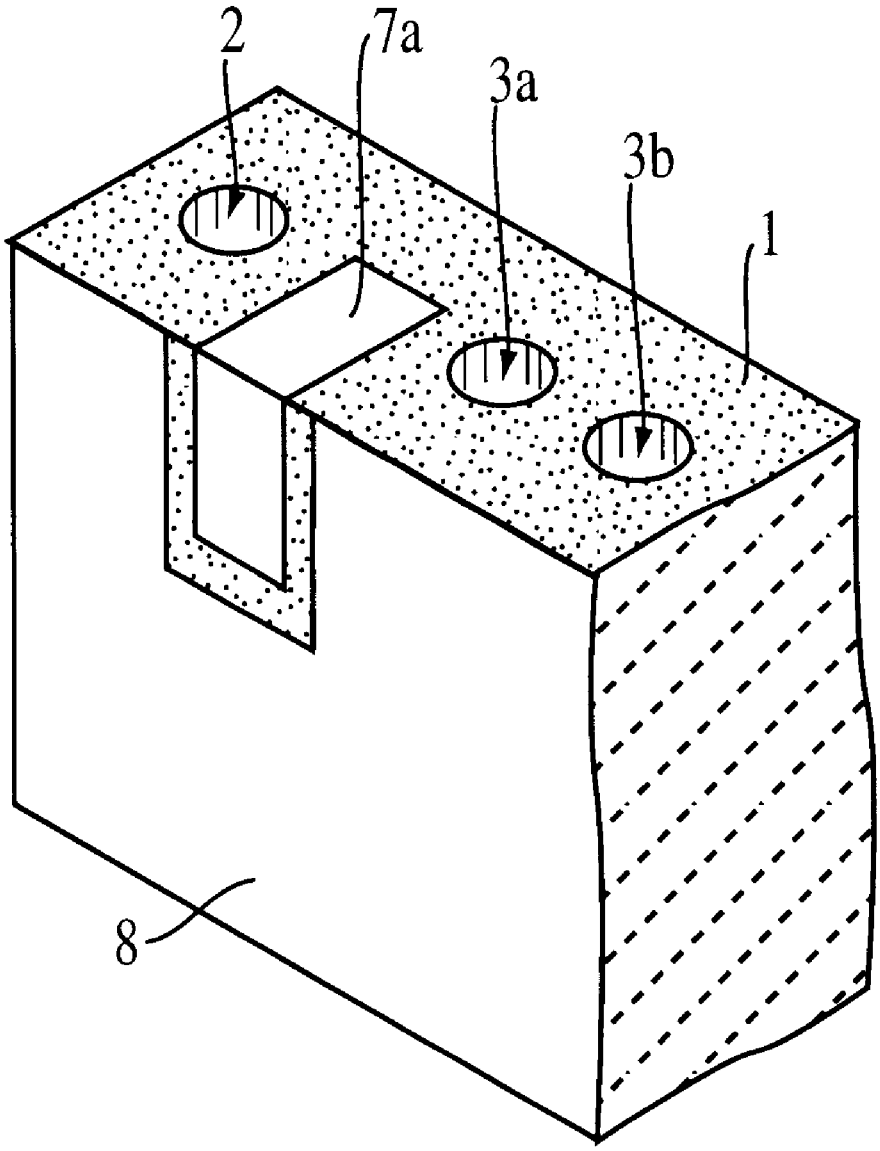
FIG. 11 is a perspective view in part of a conventional antenna sharing unit.

FIG. 10 is a perspective view in part of an antenna sharing unit according to a seventh embodiment of the present invention. In the first through the sixth embodiments, the input/output electrodes, extending from the electrodes within the respective slits, are provided. In the seventh embodiment, however, capacitance is generated between the electrode within the slit and the input/output electrode, thereby performing input and output of signals. Namely, only the top surface of the dielectric block 1 is opened, as shown in FIG. 10, by providing the slit 6*a*. Then, the input/output electrode 7*a* is provided on the lateral surface of the dielectric block 1 which opposedly faces the electrode within the slit 6*a* so as to produce capacitance between the input/output electrode 7*a* and the electrode within the slit 6*a*. In order to increase the capacitance between the electrode within the slit 6*a* and the input/output electrode 7*a*, the opposing areas therebetween may be increased or the distance therebetween may be decreased, as illustrated in FIGS. 10A and 10B. Further, in order to elevate the capacitance between the electrode within the slit 6*a* and each of the conductors within the adjacent through-holes, as well as to increase the capacitance between the electrode within the slit 6*a* and the input/output electrode 7*a*, the slit 6*a* may be configured, as shown in FIG. 10B, to increase the opposing areas between the electrode within the slit 6*a* and the internal conductors within the adjacent through-holes.

Although in the foregoing embodiments a single antenna sharing unit is formed within a single dielectric block, a plurality of antenna sharing unit may be disposed. In this case, a plurality of input/output electrodes may be provided within a single dielectric block; and among the electrodes a plurality of input/output electrodes may be used as transmitting/receiving-signal connecting electrodes, while others may be employed as a plurality of transmitting-signal input electrodes and a plurality of receiving-signal output electrodes. Moreover, although each of the above-described embodiments is used as an antenna sharing unit, the present invention may serve as a general transmitting/receiving-sharing unit (duplexer) in which an antenna connecting electrode is connected not to an antenna but to, for example, a transmission line through which transmitting and receiving signals are transmitted.

Similarly, a multiplexer may be formed within a dielectric block in the following manner. A plurality of internal conductors, slits each having an electrode therein, and input/output electrodes may be provided within a dielectric block. Among the above electrodes, a predetermined input/output electrode may be used as an output-signal or input-signal connecting electrode. If the above electrode is used as an output-signal connecting electrode, the other electrodes may serve as input-signal connecting electrodes, and vice versa. More specifically, in a manner substantially similar to the configuration illustrated in FIGS. 1 through 4, transmitting filters may be formed across the input/output electrode 7*b*, and the input/output electrode 7*b* may be used as an output-signal connecting electrode, while the input/output electrodes 7*a* and 7*c* may be employed as input-signal connecting electrodes. Thus, a two-input and one-output multiplexer (diplexer) may be constructed. Further, a plurality of rows of internal-conductor through-holes may be formed in a dielectric block, and three or more sets of dielectric filters may be each disposed across one input/output electrode. The input/output electrode may be used as an output-signal connecting electrode, while the other input/output electrodes may be employed as input-signal connecting electrodes. As a result, a multi-input and one-output multiplexer may be formed. Alternatively, the input/output relationships may be reversed to form a one-input and multi-output multiplexer.

As is seen from the foregoing description, the present invention offers the following advantages.

A slit having an electrode therein is provided between two adjacent internal conductors so as to disconnect them, thereby preventing unwanted coupling between the two filters across the above-described slit. Thus, the distance between the two filters can be decreased to enhance the miniaturization of the overall dielectric filter unit.

Further, a plurality of internal conductors may be disposed within a dielectric block, and a slit having an electrode therein and an input/output electrode are provided at least in three areas of the block. Only with this arrangement, easy designing of a compact transmitting/receiving-sharing unit can be enhanced.

Additionally, a plurality of internal conductors may be arranged within a dielectric block, and a slit having an electrode therein and an input/output electrode are provided at least in three areas of the block. Only with this configuration, simple designing of a downsized multiplexer can be facilitated.

What is claimed is:

1. A dielectric filter unit comprising:

a dielectric block;

a plurality of resonators including respective internal conductors disposed within said dielectric block; and an external conductor, a slit and a signal input/output electrode disposed on an external surface of said dielectric block, wherein said slit has an electrode therein, said electrode being directly connected to said input/output electrode, is provided between a pair of adjacent internal conductors.

2. A dielectric filter unit comprising:

a dielectric block;

a plurality of resonators including respective internal conductors disposed within said dielectric block; and an external conductor, a slit and a signal input/output electrode disposed on an external surface of said dielectric block, wherein said slit having an electrode therein and said input/output electrode are provided between a pair of adjacent internal conductors, and capacitance is generated between said electrode within the slit and said input/output electrode.

3. A transmitting/receiving-sharing unit comprising:

a dielectric block;

a plurality of resonators including internal conductors disposed within said dielectric block;

an external conductor, at least three slits and at least three signal input/output electrodes disposed on an external surface of said dielectric block;

wherein said slits have respective electrodes therein, said electrodes being directly connected to respective ones of said input/output electrodes, each of said slits being provided between respective pairs of adjacent internal conductors, and wherein said at least three said slits and said at least three input/output electrodes are provided at least in three respective areas of said dielectric block, and among said three input/output electrodes one predetermined input/output electrode is adapted for use as a transmitting/receiving-signal antenna-connecting electrode, while the other two input/output electrodes are adapted for use as a transmitting-signal input electrode and a receiving-signal output electrode, respectively.

4. A transmitting/receiving sharing unit comprising:

a dielectric block;

a plurality of resonators including internal conductors disposed within said dielectric block;

an external conductor, at least three slits and at least three signal input/output electrodes disposed on an external surface of said dielectric block;

wherein said slits having respective electrodes therein and said input/output electrodes are provided between respective pairs of adjacent internal conductors, and respective capacitances being generated between said electrodes within the slits and respective ones of said input/output electrodes, and wherein said at least three said slits and said at least three input/output electrodes are provided at least in three respective areas of said dielectric block, and among said input/output electrodes one predetermined input/output electrode is adapted to be used as a transmitting/receiving-signal antenna-connecting electrode, while the other two input/output electrodes are adapted to be used as a transmitting-signal input electrode and a receiving-signal output electrode, respectively.

5. A multiplexer comprising:

a dielectric block;

a plurality of resonators including respective internal conductors disposed within said dielectric block;

an external conductor, at least three slits and at least three signal input/output electrodes disposed on an external surface of said dielectric block; and wherein said slits have respective electrodes therein, said electrodes being directly connected to respective ones of said input/output electrodes, each of said slits being provided between respective pairs of adjacent internal conductors, and wherein said at least three said slits and said at least three input/output electrodes are provided at least in three respective areas of said dielectric block, and wherein said input/output electrodes are adapted such that among said input/output electrodes one predetermined input/output electrode is usable as an output-signal connecting electrode, while the other input/output electrodes are usable as input-signal connecting electrodes, and further, among said input/output electrodes one predetermined input/output electrode is usable as an input-signal connecting electrode, while the other input/output electrodes are usable as output-signal connecting electrodes.

6. A multiplexer comprising:

a dielectric block;

a plurality of resonators including respective internal conductors disposed within said dielectric block;

an external conductor, at 1least three slits and at least three signal input/output electrodes disposed on an external surface of said dielectric block; and wherein said slits having respective electrodes therein and said input/output electrodes are provided between respective pairs of adjacent internal conductors, and respective capacitances being generated between said electrodes within said slits and respective ones of said respective input/output electrodes, and wherein said at least three said slits and said at least three input/output electrodes are provided at least in three respective areas of said dielectric block, and wherein said input/output electrodes are adapted such that among said input/output electrodes one predetermined input/output electrode is usable as an output-signal connecting electrode, while the other input/output electrodes are usable as input-signal connecting electrodes, and further, among said input/output electrodes one predetermined input/output electrode is usable as an input-signal connecting electrode, while the other input/output electrodes are usable as output-signal connecting electrodes.

* * * * *